US008733143B2

(12) United States Patent
Kiridena et al.

(10) Patent No.: US 8,733,143 B2
(45) Date of Patent: May 27, 2014

(54) METHOD OF INCREMENTAL FORMING WITH SUCCESSIVE WRAP SURFACES

(75) Inventors: Vijitha Senaka Kiridena, Ann Arbor, MI (US); Feng Ren, Canton, MI (US); Zhiyong Cedric Xia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 336 days.

(21) Appl. No.: 12/836,989

(22) Filed: Jul. 15, 2010

(65) Prior Publication Data

US 2012/0011915 A1 Jan. 19, 2012

(51) Int. Cl.
*B21D 3/02* (2006.01)
*B21D 11/02* (2006.01)

(52) U.S. Cl.
USPC ..... 72/75; 72/115; 72/124; 72/126

(58) Field of Classification Search
USPC ..... 72/67, 81–85, 112, 115, 122, 124–126, 72/295, 296, 75
See application file for complete search history.

(56) References Cited

U.S. PATENT DOCUMENTS

| | | | | |
|---|---|---|---|---|
| 3,342,051 | A * | 9/1967 | Edward Leszak | 72/81 |
| 3,875,382 | A | 4/1975 | Cutler | |
| 4,212,188 | A | 7/1980 | Pinson | |
| 5,103,558 | A | 4/1992 | Herrick et al. | |
| 5,392,663 | A | 2/1995 | Charles | |
| 6,151,938 | A | 11/2000 | Park et al. | |
| 6,216,508 | B1 | 4/2001 | Matsubara et al. | |
| 6,532,786 | B1 | 3/2003 | Luttgeharm | |
| 6,561,002 | B2 | 5/2003 | Okada et al. | |
| 6,971,256 | B2 | 12/2005 | Okada et al. | |
| 7,536,892 | B2 * | 5/2009 | Amino et al. | 72/305 |
| 2001/0029768 | A1 | 10/2001 | Okada et al. | |
| 2004/0187545 | A1 | 9/2004 | Okada et al. | |
| 2004/0187548 | A1 | 9/2004 | Okada et al. | |
| 2006/0272378 | A1 | 12/2006 | Amino et al. | |
| 2009/0158805 | A1 | 6/2009 | Callebaut et al. | |
| 2010/0199742 | A1 * | 8/2010 | Johnson et al. | 72/386 |
| 2010/0257909 | A1 * | 10/2010 | Huskamp et al. | 72/21.1 |

FOREIGN PATENT DOCUMENTS

| | | | |
|---|---|---|---|
| EP | 1731238 | A1 | 12/2006 |
| EP | 1899089 | A2 | 3/2008 |

OTHER PUBLICATIONS

U.S. Appl. No. 12/369,336, filed Feb. 11, 2009; "System and Method for Incrementally Forming a Workpiece", C. Johnson et al.
"Dieless Incremental Sheet Metal Forming Technology," Applied Plasticity Research Group, publication date unknown.
"Dieless NC Forming," www.the fabricator.com, by Taylan Altan, Jun. 12, 2003.
"Dieless Sheet Forming," Se-Prof Technology Services Ltd., printed Oct. 16, 2008, publication date unknown.
"Octahedral Hexapod Design Promises Enhanced Machine Performance," Ingersoll Milling Machine Company, printed Oct. 7, 2008, publication date unknown.

(Continued)

*Primary Examiner* — Debra Sullivan
(74) *Attorney, Agent, or Firm* — Damian Porcari; Brooks Kushman P.C.

(57) ABSTRACT

A method of incrementally forming a workpiece. The method includes incrementally forming a first monotonic wrap surface in a first direction and incrementally forming a second wrap surface in a second direction disposed opposite the first direction.

20 Claims, 3 Drawing Sheets

(56) References Cited

OTHER PUBLICATIONS

"Computer Numerically Controlled Dieless Incremental Forming of a Sheet Metal," by S. Matsubara, University of Industrial Technology, Sagamihara-shi, Japan, May 25, 2001.
"Incremental Forming of Sheet Metal," by J. Cao, V. Reddy and Y. Wang, Northwestern University, publication date unknown.
"Sheet Metal Dieless Forming and its tool path generation based on STL files," by L. .Jie, M. Jianhua, and H. Shuhual; Springer London, Feb. 19, 2004.
"A review of conventional and modern single-point sheet metal forming methods," by E. Hagan and J. Jeswlet, Queen's University, Kingston, Ontario, Canada, Sep. 19, 2002.
"Investigation into a new incremental forming process using an adjustable punch set for the manufacture of a double curved sheet metal," by S. J. Yoon and D. Y. Yang; Korea Advanced Institute of Science of Technology; Taejon, Korea; Feb. 5, 2001.
"Principle and applications of multi-point matched-die forming for sheet metal," by M-Z Li-, Z-Y Cal, Z. Sui, and X-J Li, Jilin University, Changchun, People's Republic of China, Jan. 9, 2008.

* cited by examiner

METHOD OF INCREMENTAL FORMING WITH SUCCESSIVE WRAP SURFACES

BACKGROUND

Technical Field

The present invention relates to a method of incrementally forming a workpiece.

SUMMARY

In at least one embodiment, a method of incrementally forming a workpiece is provided. The method includes incrementally forming a first monotonic wrap surface in a first direction and incrementally forming a second wrap surface in a second direction disposed opposite the first direction.

In at least one embodiment, a method of incrementally forming a workpiece is provided. The method includes incrementally forming a first monotonic wrap surface in a first direction with respect to an initial workpiece position and incrementally forming a second monotonic wrap surface completely within the first monotonic wrap surface in a second direction disposed opposite the first direction.

In at least one embodiment, a method of incrementally forming a workpiece is provided. The method includes incrementally forming a convex surface on the workpiece and incrementally forming a concave surface within the convex surface. No additional convex surface is formed in any area of the workpiece in which the concave surface is not formed.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. In addition, any or all features from one embodiment may be combined with any other embodiment. Therefore, specific structural and functional details disclosed herein are not to be interpreted as limiting, but merely as a representative basis for the claims and/or as a representative basis for teaching one skilled in the art to variously employ the present invention.

Figure 1:
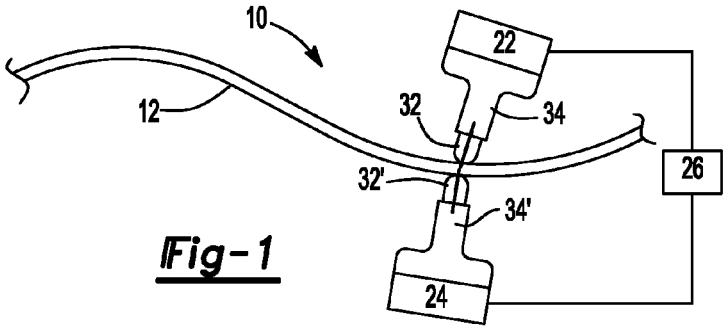
FIG. 1 is an exemplary side view of an incremental workpiece forming system forming a workpiece.
Figure 2:
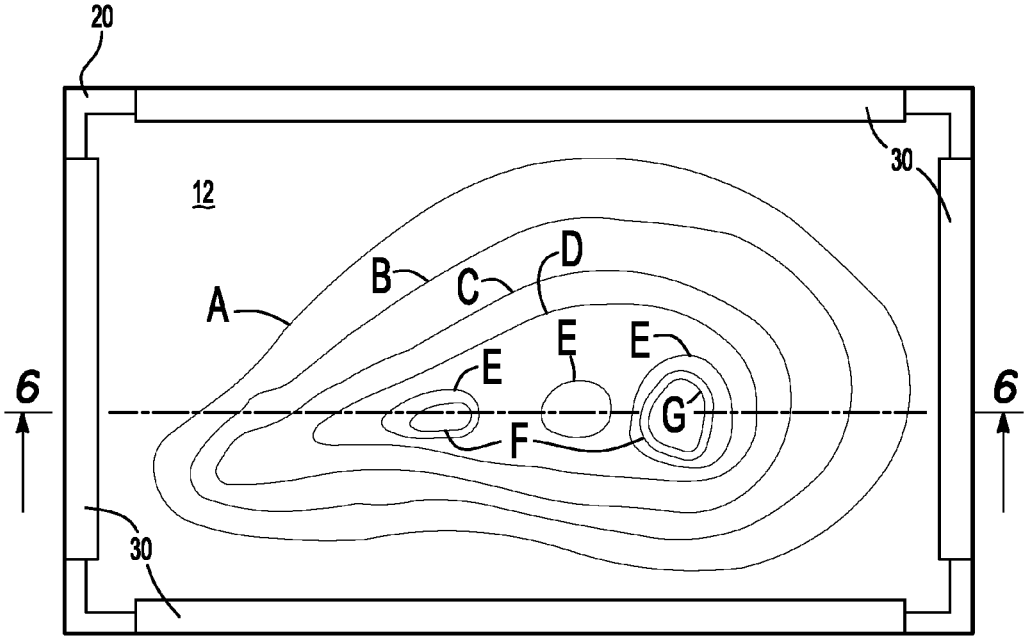
FIG. 2 is a top topographic view of an exemplary workpiece after incremental forming.

Referring to FIGS. 1 and 2, an exemplary system 10 for incrementally forming a workpiece 12 is shown. The workpiece 12 may be made of any suitable material or materials that have desirable forming characteristics, such as a metal, metal alloy, polymeric material, or combinations thereof. In at least one embodiment, the workpiece 12 may be provided as sheet metal. The workpiece 12 may be provided in an initial configuration that is generally planar or that is at least partially preformed into a non-planar configuration in one or more embodiments.

The system 10 may be used to incrementally form a workpiece. In incremental forming, a workpiece is formed into a desired configuration by a series of small incremental deformations. The small incremental deformations may be provided by moving one or more tools along or against one or more surfaces of the workpiece. Tool movement may occur along a predetermined or programmed path. In addition, a tool movement path may be adaptively programmed in real-time based on measured feedback, such as from the load cell. Thus, incremental forming may occur in increments as at least one tool is moved and without removing material from the workpiece. More details of such a system 10 are described in U.S. patent application Ser. No. 12/369,336, which is assigned to the assignee of the present application and is hereby incorporated by reference in its entirety. A brief summary of some components of such a system 10 is provided below.

The system 10 may include a plurality of components that facilitate forming of the workpiece 12, such as a fixture assembly 20, a first manipulator 22, a second manipulator 24, and a controller 26.

The fixture assembly 20 may be provided to support the workpiece 12. The fixture assembly 20 may be configured as a frame that at least partially defines an opening 28 (shown in FIG. 3). The workpiece 12 may be disposed in or at least partially cover the opening 28 when the workpiece 12 is received by the fixture assembly 20.

The fixture assembly 20 may include a plurality of clamps 30 that may be configured to engage and exert force on the workpiece 12. The clamps 30 may be provided along multiple sides of the opening 28 and may have any suitable configuration and actuation mechanism. For instance, the clamps 30 may be manually, pneumatically, hydraulically, or electrically actuated. Moreover, the clamps 30 may be configured to provide a fixed or adjustable amount of force upon the workpiece 12.

First and second positioning devices or manipulators 22, 24 may be provided to position first and second forming tools 32, 32'. The first and second manipulators 22, 24 may have multiple degrees of freedom, such as hexapod manipulators that may have at least six degrees of freedom. The manipulators 22, 24 may be configured to move an associated tool along a plurality of axes, such as axes extending in different orthogonal directions like X, Y and Z axes.

The first and second forming tools 32, 32' may be received in first and second tool holders 34, 34', respectively. The first and second tool holders 34, 34' may be disposed on a spindle and may be configured to rotate about an associated axis of rotation in one or more embodiments.

The forming tools 32, 32' may impart force to form the workpiece 12 without removing material. The forming tools 32, 32' may have any suitable geometry, including, but not limited to flat, curved, spherical, or conical shape or combinations thereof.

The one or more controllers 26 or control modules may be provided for controlling operation of the system 10. The controller 26 may be adapted receive CAD or coordinate data and provide computer numerical control (CNC) to form the workpiece 12 to design specifications. In addition, the controller 26 may monitor and control operation of a measurement system that may be provided to monitor dimensional characteristics of the workpiece 12 during the forming process.

Referring to FIG. 2, a top topographic view of an exemplary workpiece 12 in a final configuration after completion of incremental forming is shown. Letters A through G refer to contour lines that represent contiguous points having the same distance from a reference position or reference plane, similar to contour lines that show points having the same altitude on a topographic map. The reference position may be an initial position of the workpiece 12 or another datum reference as will be described in more detail below. Contour lines A through G coincide with distances A through G shown along the vertical axis in the section view in FIG. 6.

Figure 3:
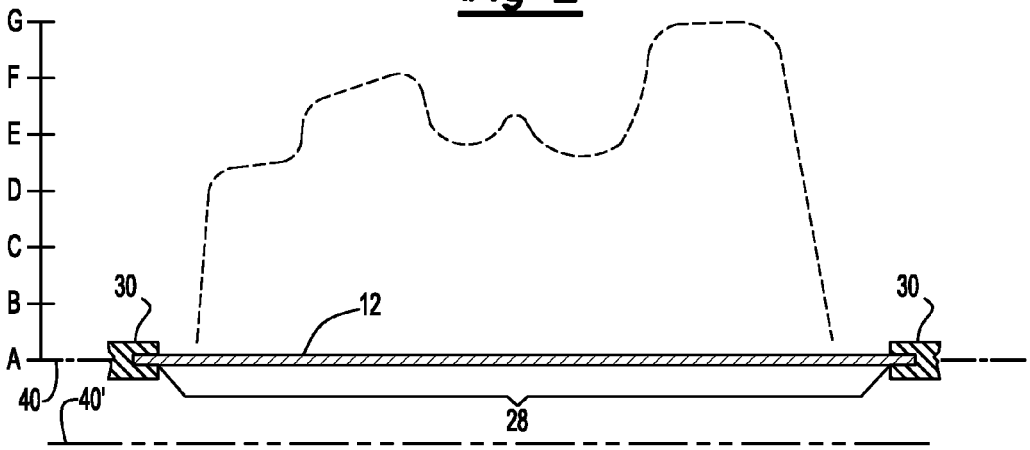
FIG. 3 is an exemplary side section view of a workpiece prior to incremental forming.
Figure 4A:
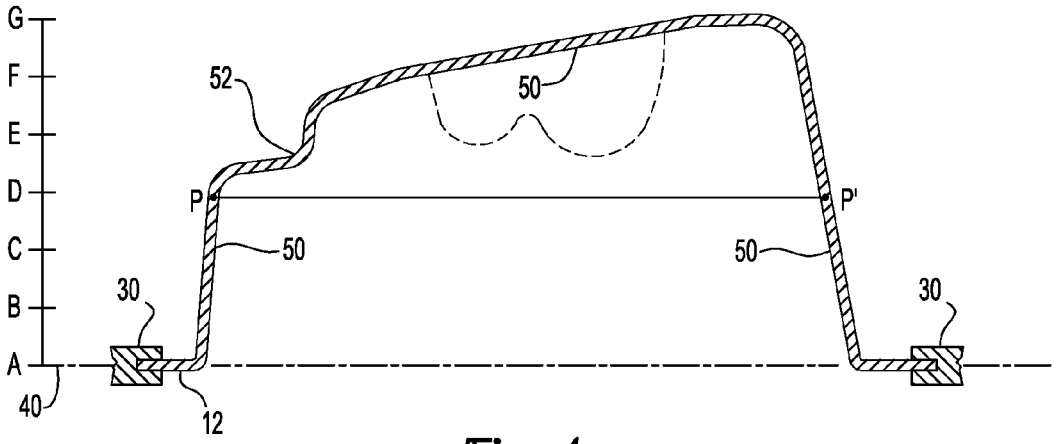
FIGS. 4*a*, 4*b*, 5 and 6 are exemplary side section views of the workpiece undergoing a sequence of incremental forming steps.
Figure 4B:
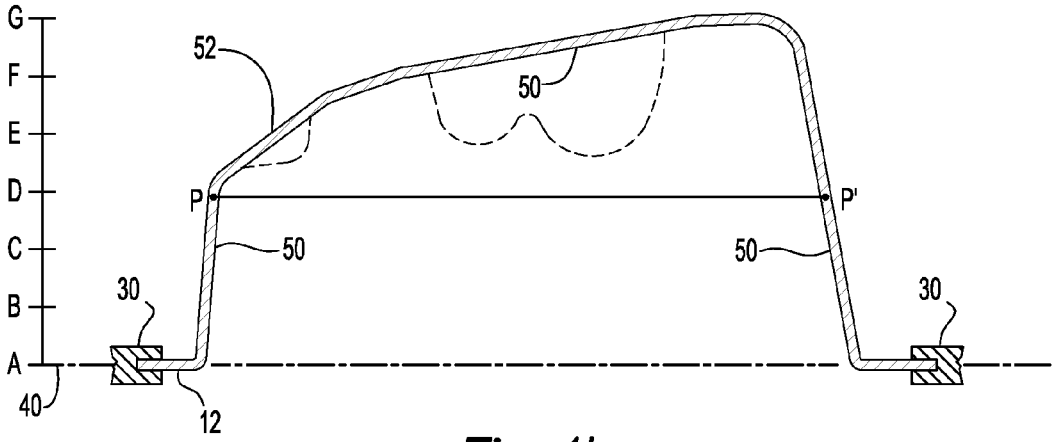
Figure 5:
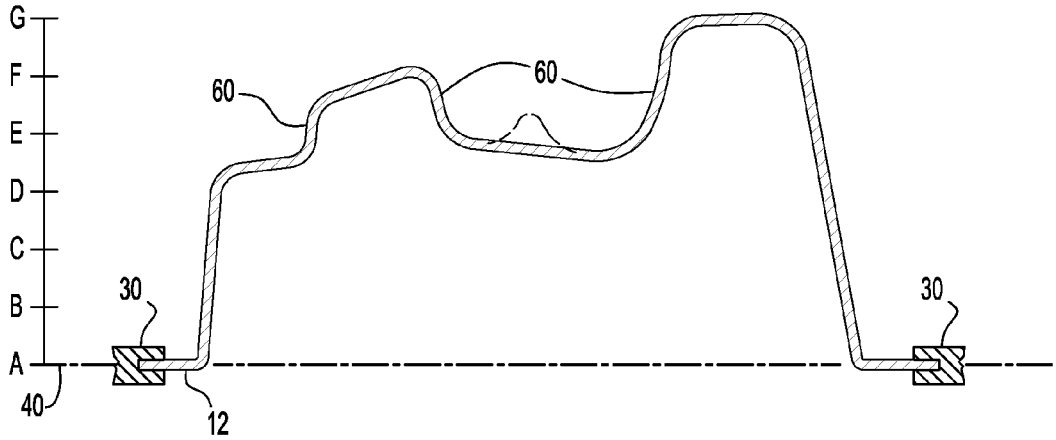

Referring to FIGS. 3-6, an exemplary method of incrementally forming a workpiece is illustrated. More specifically, FIGS. 3-6 are section views of the workpiece 12 during different stages of incremental forming along section line 6-6 in FIG. 2. The phantom lines in FIGS. 3-5 illustrate a desired or final configuration of the workpiece 12 in regions where incremental forming has not been completed.

Referring to FIG. 3, the workpiece 12 is shown in an initial configuration in solid lines. The initial configuration of the workpiece 12 may be the configuration or shape of the workpiece 12 prior to incremental forming. The initial configuration may be substantially planar as shown. Alternatively, the workpiece 12 may be preformed or provided such that at least a portion of the workpiece 12 is non-planar prior to incremental forming.

The initial configuration of the workpiece 12 may define a reference configuration or reference plane from which subsequent incremental forming steps may be described or referenced. For instance, for a workpiece 12 having a substantially planar initial configuration a reference plane 40 may be a plane in which the workpiece 12 is disposed. For a non-planar workpiece, a reference configuration or reference plane may be a surface of the workpiece 12 that has not been preformed prior to incremental forming. In addition, a reference configuration may be a mathematically defined surface or datum that does not intersect the workpiece 12. For example, such a reference surface may be a plane or surface that is disposed parallel to but spaced apart from at least a portion of the workpiece 12 when in an initial configuration, such as reference plane 40'. Alternatively, a point, line or other surface may be used as a reference point or datum in various embodiments.

Referring to FIGS. 4*a*, 4*b*, 5 and 6, an exemplary sequence of incremental forming steps in accordance with the method are illustrated. More specifically, the method includes incrementally forming one or more wrap surfaces or wrap surface levels on the workpiece 12. A plurality of wrap surfaces may be incrementally formed in a predetermined sequence. Sequential or successive wrap surfaces may be formed in alternating or different directions. For instance, a first wrap surface may be formed in a first direction, a second wrap surface may be formed in a second direction, a third wrap surface may be formed in the first direction, etc. In addition, sequential wrap surfaces may be incrementally formed in an alternating pattern, such as by forming a first wrap surface that is at least partially convex, a second wrap surface that is at least partially concave, a third wrap surface that is at least partially convex, and so on.

A wrap surface may be defined in different ways. For instance, a wrap surface may be defined as a surface or contour that is incrementally formed on the workpiece 12 in a monotonic manner or as a monotonic surface. A monotonic wrap surface may be defined in different ways. A first definition of a monotonic wrap surface from a section view perspective as (1) an incrementally formed surface of the workpiece (2) that is formed in a common direction with respect to a reference plane or datum (3) in which a line that connects any two points on the incrementally formed surface that are located at a common distance from the reference plane or datum (4) is located within the surface or surface volume that has been incrementally formed. A second definition of a monotonic wrap surface from a section view perspective may be (1) an incrementally formed surface of workpiece (2) that is formed in a common direction with respect to a reference plane or datum (3) in which the incrementally formed surface is at least partially concave but not convex or at least partially convex but not concave with respect to the reference plane. A third definition of a monotonic wrap surface from a section view perspective may be (1) an incrementally formed surface of workpiece (2) that is formed in a common direction with respect to a reference plane or datum (3) in which the incrementally formed surface is completely concave or completely convex with respect to the reference plane. A wrap surface may satisfy one or more of the previous definitions.

Successive wrap surfaces may be incrementally formed on the workpiece 12. The forming of successive wrap surfaces may be described in terms of different levels or as a parent-child hierarchy in which a child wrap surface may be incrementally formed inside or completely within a parent wrap surface. For example, a parent wrap surface may be incrementally formed, then a child wrap surface may be incrementally formed within the parent wrap surface. If desired, a grandchild wrap surface may then be formed within the child wrap surface and so on. Successive wrap surfaces may be formed in alternating directions. For instance, if a parent wrap surface is at least partially convex, then a child wrap surface may be at least partially convex or vice versa. Similarly, if a child wrap surface is at least partially convex, then a grandchild wrap surface may be at least partially concave or vice versa.

A workpiece 12 may have multiple wrap surfaces at the same level or generation in a parent-child hierarchy. For instance, there may be multiple child-level wrap surfaces formed in a parent wrap surface. Such child-level wrap surfaces and their offspring may be incrementally formed in various sequences. For instance, all child-level wrap surfaces may be formed before forming grandchild-level wrap surfaces (e.g., first and second child-level wrap surfaces may be formed before first and second grandchild-level wrap surfaces, if provided). Another sequence would include forming a complete sequence or branch of wrap surfaces before forming another branch in the parent-child hierarchy. For instance, a first child-level wrap surface and its descendents (if any) may be incrementally formed, then a second child-level wrap surface and it descendents (if any) may be incrementally formed, and so on. The present invention also contemplates that wrap surfaces may be formed using combinations of the above.

Referring to FIG. 4*a*, an example of a monotonic wrap surface is shown. In FIG. 4*a*, the workpiece 12 is shown after incrementally forming an exemplary parent-level or first wrap surface 50. The first wrap surface 50 is represented by the portion of the workpiece 12 that has been formed with respect to FIG. 3. From a section view perspective, a line that connects any two points located at a common height or common distance from the reference surface 40 or 40', such as a horizontal line from point P to P', is completely located within the surface volume that has been incrementally formed (e.g., a horizontal line intersects the incrementally formed portion of the workpiece at two points). It is to be understood that such a horizontal line may represent a monotonic plane from a three dimensional perspective. As such, a monotonic plane may intersect the incrementally formed surface along a continuous ring.

FIG. 4*b* is another example of a monotonic first wrap surface. In FIG. 4*b*, the first wrap surface 50 is completely convex with respect to reference surface 40, 40'. This differs from FIG. 4*a* in that a portion 52 of the incrementally formed surface is convex in FIG. 4*b* but not in FIG. 4*a*.

In FIGS. 4*a* and 4*b*, the first wrap surface 50 is incrementally formed in a first direction with respect to a reference configuration or a reference plane. The first direction may extend upward and away from the initial position of the workpiece 12. The first direction may be along an axis that extends substantially perpendicular to the initial position of the workpiece 12 and/or the reference plane 40, 40' in one or more embodiments.

Referring to FIG. 5, the workpiece 12 is shown after incrementally forming a second wrap surface 60. It is noted that the portion of second wrap surface 60 located at the left side of FIG. 5 would be formed with respect to FIG. 4*b*, but not FIG. 4*a*. The second wrap surface 60 may be incrementally formed in a second direction that may be opposite the first direction. For instance, the second direction may extend downward or toward the initial workpiece position or toward the reference plane 40, 40'. From a section view perspective, the second wrap surface 60 may be disposed completely within the first wrap surface 50. The second wrap surface 60 may be disposed closer to a reference plane 40, 40' than an immediately adjacent portion of the first wrap surface 50. In addition, the second wrap surface 60 may be concave with respect to the reference plane 40, 40'. As such, a concave wrap surface may be formed completely within an area of the workpiece 12 in which a convex wrap surface was previously formed. In embodiments where the first wrap surface 50 is at least partially convex but not concave or completely convex, no additional convex wrap surface may be subsequently formed therein unless another wrap surface that is at least partially concave is first formed. In addition, the second wrap surface 60 may be provided as a child-level wrap surface and as such may be formed in various sequences as described above.

Figure 6:
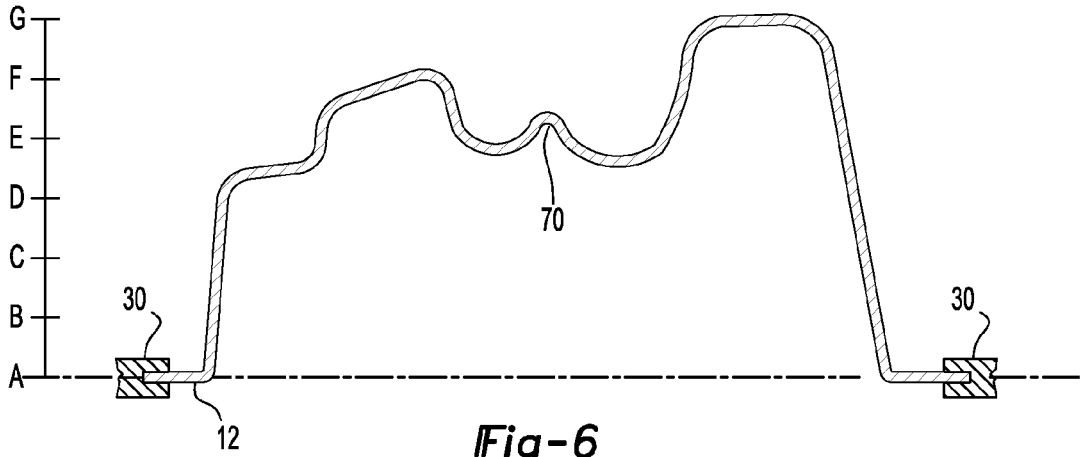

In FIG. 6, the workpiece 12 is shown after incrementally forming a third wrap surface 70. The third wrap surface 70 may be incrementally formed in the first direction, or the same direction as the first wrap surface 50. In addition, the third wrap surface 70 may be convex with respect to the reference plane 40, 40'. From a section view perspective, the third wrap surface 70 may be disposed completely within the second wrap surface 60. In addition, the third wrap surface 70 may be disposed further from a reference plane 40, 40' than an immediately adjacent portion of the second wrap surface 60.

Additional wrap surfaces may be formed subsequent to forming a third wrap surface 70 by continuing to alternate the directions in which the workpiece 12 in incrementally formed. In addition, each subsequent wrap surface may be formed within an immediately preceding wrap surface. For instance, a fourth wrap surface may be formed within the third wrap surface, a fifth wrap surface may be formed within the fourth wrap surface, and so on until the final configuration of the workpiece 12 is obtained. Moreover, in one or more embodiments, no wrap surface may be formed in the second direction in any area of the workpiece 12 that has not already had a wrap surface formed therein in the first direction.

Incremental forming in accordance with the method and wrap surfaces described above may help precisely control execution of tool paths during incremental forming and may help improve the resultant workpiece geometry. As such, the final workpiece geometry may more precisely reflect or match the desired or design intent geometry of the workpiece. In addition, tool paths may be more readily or easily calculated or programmed, thereby improving throughput and manufacturing logistics.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A method of incrementally forming a workpiece, comprising:

incrementally forming a first monotonic wrap surface in a first direction, and incrementally forming a second monotonic wrap surface in a second direction disposed opposite the first direction;

wherein the first and second monotonic wrap surfaces are formed without inverting the workpiece by first and second tools that move along multiple axes along opposite surfaces of the workpiece; and wherein the first monotonic wrap surface is convex and the second monotonic wrap surface is completely concave and formed completely within the first monotonic wrap surface.

2. The method of claim 1 wherein the second monotonic wrap surface is incrementally formed after forming the first monotonic wrap surface.

3. The method of claim 1 wherein the first monotonic wrap surface is at least partially convex but not concave.

4. The method of claim 1 wherein the first monotonic wrap surface is completely convex.

5. The method of claim 1 wherein the first and second tools are both configured to rotate.

6. The method of claim 1 wherein the first monotonic wrap surface is convex with respect to a reference plane and the second monotonic wrap surface is concave with respect to the reference plane.

7. The method of claim 1 further comprising a third wrap surface disposed completely within the second monotonic wrap surface, wherein the third wrap surface is formed in the first direction.

8. The method of claim 7 wherein the third wrap surface is monotonic.

9. The method of claim 7 wherein the third wrap surface is at least partially convex but not concave.

10. A method of incrementally forming a workpiece, comprising:

incrementally forming a first monotonic wrap surface in a first direction with respect to an initial workpiece position; and incrementally forming a second monotonic wrap surface completely within the first monotonic wrap surface in a second direction disposed opposite the first direction;

incrementally forming a third monotonic wrap surface in the first direction after forming the second monotonic wrap surface, wherein the third monotonic wrap surface is disposed completely within the second monotonic wrap surface;

wherein first and second tools move simultaneously along multiple axes along opposite surfaces of the workpiece to incrementally form the first, second, and third monotonic wrap surfaces.

11. The method of claim 10 wherein the initial workpiece position is substantially planar.

12. The method of claim 11 wherein the first direction extends substantially perpendicular to the initial workpiece position.

13. The method of claim 10 wherein the first monotonic wrap surface is at least partially convex.

14. The method of claim 10 wherein the second monotonic wrap surface is at least partially concave.

15. The method of claim 10 wherein the first monotonic wrap surface is completely convex and the second monotonic wrap surface is completely concave.

16. The method of claim 10 further comprising forming a fourth monotonic wrap surface in the second direction, wherein the fourth monotonic wrap surface is disposed completely within the third monotonic wrap surface.

17. A method of incrementally forming a workpiece, comprising:

incrementally forming a convex surface; and incrementally forming a concave surface within the convex surface;

incrementally forming a second convex surface completely within the concave surface after forming the convex and concave surfaces;

wherein no additional convex surface is formed in any area of the workpiece in which the concave surface is not formed;

wherein the convex surface, second convex surface, and concave surface are formed without inverting the workpiece by first and second tools that move simultaneously along multiple axes along opposite surfaces of the workpiece.

18. The method of claim 17 wherein no additional concave surface is formed in any area of the workpiece in which the second convex surface has not been formed.

19. The method of claim 18 wherein the second convex surface is disposed further from the reference plane than the a immediately adjacent portion of the concave surface and closer to the reference plane than the convex surface.

20. The method of claim 17 wherein the concave surface is disposed closer to a reference plane than an immediately adjacent portion of the convex surface.

* * * * *